United States Patent [19]

Johnson

[11] Patent Number: 4,538,866

[45] Date of Patent: Sep. 3, 1985

[54] BACKPLANE CONNECTOR

[75] Inventor: Lennart B. Johnson, Milford, N.H.

[73] Assignee: Teradyne, Inc., Boston, Mass.

[21] Appl. No.: 473,037

[22] Filed: Mar. 7, 1983

[51] Int. Cl.[3] ..... H01R 13/62

[52] U.S. Cl. ..... 339/17 LM; 339/74 R; 339/75 M

[58] Field of Search ..... 339/74 R, 75 M, 17 M, 339/17 LM

[56] References Cited

U.S. PATENT DOCUMENTS

| | | | |
|---|---|---|---|
| 3,264,597 | 8/1966 | Gammel, Sr. | 339/17 LM |
| 3,587,037 | 6/1971 | Anhalt | 339/75 M |
| 4,075,444 | 2/1978 | Hollingshead et al. | 339/75 M |
| 4,217,020 | 8/1980 | Holland | 339/75 M |
| 4,331,372 | 5/1982 | Bright | 339/74 R |
| 4,420,205 | 12/1983 | Kirkman | 339/74 R |

*Primary Examiner*—John McQuade

[57] ABSTRACT

The combination of a backplane having a plurality of backplane contacts, a daughter printed circuit board, and a daughter board connector carrying a plurality of contacts and means for applying a translational force between the backplane contacts and connector contacts.

4 Claims, 5 Drawing Figures

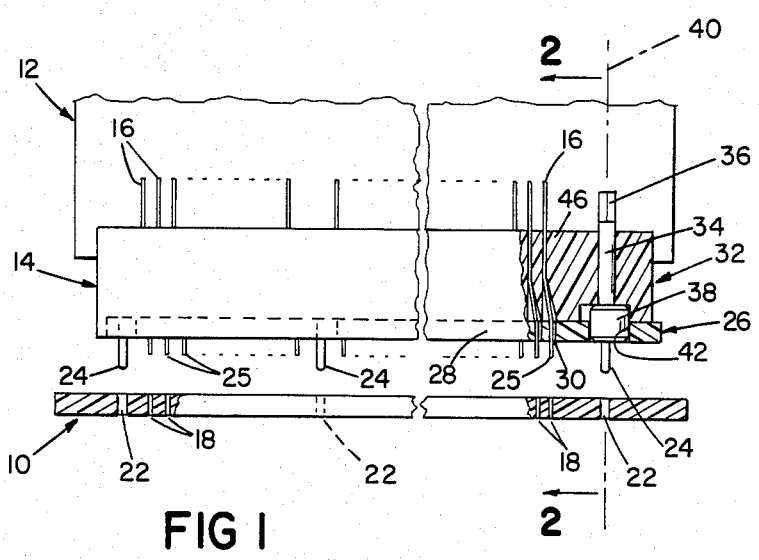
FIG 1
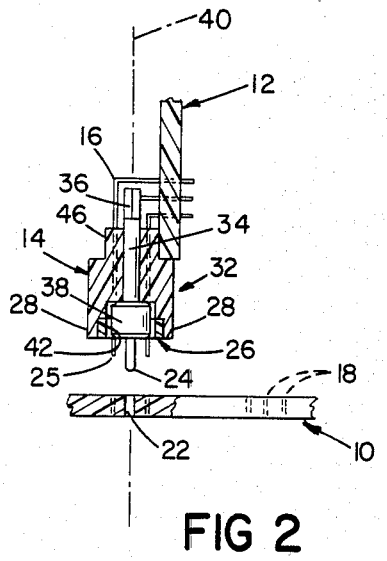
FIG 2
FIG 3
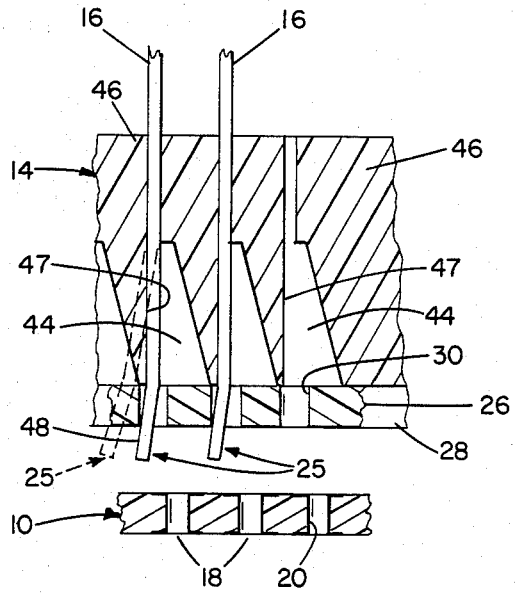
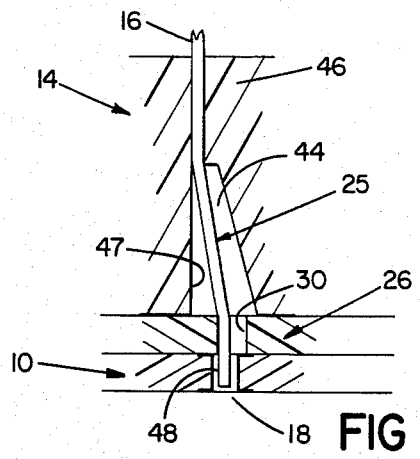
FIG 4
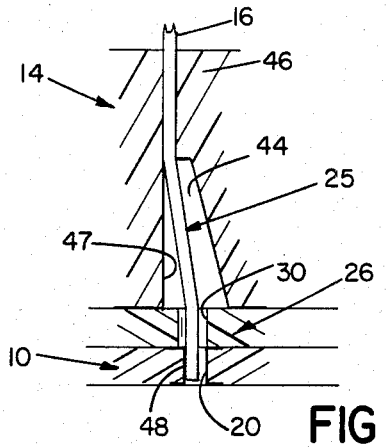
FIG 5

BACKPLANE CONNECTOR

FIELD OF THE INVENTION

The invention relates to detachably mounting a daughter printed circuit board (PCB) on a backplane.

BACKGROUND OF THE INVENTION

Backplanes are printed circuit boards or metal plates on the upper side of which "daughter" PCBs are detachably mounted perpendicularly to the backplanes for easy removal. One way of electrically connecting the daughter boards to other daughter boards, the backplane, and other circuitry is by providing metallized surface portions near the edges of the daughter boards and inserting them between the forked prongs of electrical connectors that are secured to the backplane. Another way of making electrical connection to the daughter boards involves using post and box connectors.

Normal forces of 50–100 grams between contacts for making electrical connection between the daughter boards and the backplane are generally needed for reliable electrical connection. With conventional contacts, such normal forces have corresponding insertion forces of approximately 85–115 grams. If there are 300–500 contacts on a daughter board, the total engagement force can exceed 100 pounds.

Some prior systems have provided low insertion forces and subsequent increasing of normal forces by using cams to open, during insertion of the daughter board contacts, backplane contacts that grip the daughter board contacts between opposing portions.

SUMMARY OF THE INVENTION

In general the invention features a daughter board connector that has means to apply a translational force between the daughter board connector contacts and the backplane contacts without gripping the contacts. The daughter board is thus mounted on the backplane with a very low insertion force; there are high normal forces between the connector contacts and the backplane contacts after the translational force is applied, and because of the simple nature of the mechanism, a large number of contacts can be placed in a small area.

In some preferred embodiments the means to apply a translational force comprises a slidable cam plate that moves the connector contacts in a direction parallel to the backplane; the connector has one or more guide pins for mating with holes on the backplane; the cam plate moves free ends of daughter board contacts prior to mounting on the backplane, and the free ends are released to resiliently engage the backplane contacts; the free ends are prestressed during manufacture; and the backplane contacts are plated-through holes of the backplane.

In another preferred embodiment means to apply a translational force is a cam that moves the connector relative to the backplane after the connector has been mounted on the backplane.

DESCRIPTION OF THE PREFERRED EMBODIMENT

The structure and operation of the presently preferred embodiment of the invention will now be described after first briefly describing the drawings.

DRAWINGS

FIG. 1 is an elevation, partially broken away, of a system for detachably mounting a printed circuit board on a backplane.

FIG. 2 is a side view, partially broken away, of the FIG. 1 system.

FIGS. 3–5 are diagrammatic, vertical sectional views of portions of the FIG. 1 system, showing engagement of contacts of the FIG. 1 system.

STRUCTURE

Referring to FIG. 1, there is shown backplane 10, daughter board 12, and daughter board connector 14, carrying a plurality of daughter board contacts 16. Backplane 10 is between 0.062 and 0.187" thick, and has a plurality of holes 18 (0.040" diameter) plated through with gold, to provide backplane contacts 20, and larger holes 22, for receiving guide pins 24 of daughter board connector 14.

The upper ends of contacts 16 are soldered to metallization on daughter board 12 to electrically connect them to components on the daughter board. Free ends 25 of daughter board contacts 16 extend downward from connector 14 and are arranged for mating with respective holes 18 in backplane 10. Cam plate 26 (0.062" thick high tensile strength mineral fiber (Kevlar, duPont trademark, or graphite) in epoxy composite) is mounted for limited sliding in tracks 28 of connector 14 and has a plurality of apertures 30 (0.050" to 0.060" diameter) through which ends 25 of contacts 16 pass. Cam means 32 has shaft 34 and square head 36 extending above connector 14. Cam portion 38 is off center of axis 40 and cooperates with the sidewalls of hole 42 in cam plate 26, so that rotation of cam means 32 causes plate 26 to move horizontally.

Referring to FIGS. 3–5, it is seen that each free end 25 of contact 16 is movable within region 44 of plastic (creep resistant, high tensile strength polyacetylene-sulfide, available from Phillips Petroleum under the trade designation Ryton) connector piece 46. Contact 16 is 0.018" thick and 0.040" wide. Free end 25 is ½ long, is gold plated at contact surface 48, and is bent prior to press fitting in member 46, causing it to press against wall 47. The dashed lines indicate the position free end 25 would occupy if it were not contacting wall 47 of region 44. Region 44 is about 0.045" wide at its bottom.

OPERATION

In use, when daughter board 12 is to be mounted on backplane 10, cam plate 26 starts out in a position furthest to the left, as shown in Fig. 3. Here each free end 25 is already forced against side wall 47 with a normal force of about 30 gm, owing to its initial bending before mounting.

Free ends 25 are then stressed even more by turning nut head 36 so that off center cam portion 38 moves within hole 42 and biases cam plate 26 to the right to the position shown in FIG. 4. Guide pins 24 are then inserted in holes 22, aligning free ends 25 with holes 18, and free ends 25 are inserted in the holes with a very low insertion force.

Square head 36 is then rotated again so that cam plate 26 moves to the left to the position shown in FIG. 5 with gold plated surfaces 48 contacting contacts 20 of backplane 10. In this position free ends 25 push against the left hand inner walls of holes 18 while guide pins 24 push against the right hand walls of the holes 22. Because contacts 16 are prestressed, high normal forces are obtained with small movements of cam plate 26.

OTHER EMBODIMENTS

Other embodiments of the invention will become apparent to those skilled in the art. For example, instead of plated-through backplane contacts 20 in holes 18, male contacts extending upward from holes 18 can be used to mate with contacts 16. Also, instead of cam plate 26, cam portion 38 can mate with a hole in backplane 10 to move backplane 10 relatively to connector 14 after insertion of the contacts in the backplane holes.

What is claimed is:

1. The combination comprising a backplane having a plurality of guide pin holes through said backplane and a plurality of backplane contacts provided by plated-through contact holes through said backplane, a daughter printed circuit board, and a daughter board connector carrying a plurality of guide pins and a plurality of daughter board contacts in a connector piece of insulating material, said daughter board contacts having first portions electrically connected to components on said board, second portions extending from said daughter board perpendicular to it, and third portions perpendicular to said second portions and having free ends extending from said connector for mating with respective said contact holes, said guide pins also extending from said connector in the same direction as said free ends for mating with said guide pin holes, said daughter board connector having a cam plate slidably mounted relative to said connector piece and having holes through which said free ends of said contacts pass and cam means for translating said plate and thereby applying a force between said guide pins and said free ends so that a normal force is provided between said free ends and the sides of said plated through holes.

2. The system of claim 1 wherein said cam plate is adapted to move said free ends to bend said daughter board contacts prior to insertion in said contact holes through said backplane, and to permit said daughter board contacts to resiliently move against said backplane contacts after insertion.

3. The system of claim 2 wherein said daughter board contacts are bent for prestressing during manufacture.

4. The system of claim 2 wherein said means for applying a translational force comprises cam means extending upward from said connector with an associated accessible nut to actuate said cam plate.

* * * * *